US008863791B2

(12) United States Patent
Aehle et al.

(10) Patent No.: US 8,863,791 B2
(45) Date of Patent: Oct. 21, 2014

(54) HOSE FUEL NOZZLE

(75) Inventors: Achim Aehle, Wedel (DE); Stefan Kunter, Hamburg (DE); Heinz-Ulrich Meyer, Hamburg (DE); Michael Wehner, Hamburg (DE)

(73) Assignee: Elaflex Hiby Tanktechnik GmbH & Co., Hamburg (DE)

( * ) Notice: Subject to any disclaimer, the term of this patent is extended or adjusted under 35 U.S.C. 154(b) by 851 days.

(21) Appl. No.: 13/016,968

(22) Filed: Jan. 29, 2011

(65) Prior Publication Data

US 2011/0186176 A1 Aug. 4, 2011

(30) Foreign Application Priority Data

Jan. 29, 2010 (EP) ..... 10000919

(51) Int. Cl.
*B67C 3/00* (2006.01)
*F17C 5/02* (2006.01)

(52) U.S. Cl.
CPC ..... *F17C 5/02* (2013.01); *F17C 2260/036* (2013.01); *F17C 2265/065* (2013.01); *F17C 2270/0165* (2013.01); *F17C 2205/0376* (2013.01); *F17C 2225/0161* (2013.01); *F17C 2223/0161* (2013.01)
USPC ..... 141/350; 141/198; 141/348; 141/349

(58) Field of Classification Search
CPC ..... B67D 7/42; B67D 7/005; F17C 13/04; F17C 2205/0376; B60S 5/02
USPC ..... 141/318, 346, 348–355, 362, 383–386, 141/198
See application file for complete search history.

(56) References Cited

U.S. PATENT DOCUMENTS

| | | | | |
|---|---|---|---|---|
| 2,712,402 | A * | 7/1955 | Le Clair | 141/383 |
| 4,763,683 | A * | 8/1988 | Carmack | 137/68.15 |
| 4,919,174 | A * | 4/1990 | Warland | 141/384 |
| 5,467,806 | A * | 11/1995 | Stricklin et al. | 141/346 |
| 5,725,034 | A * | 3/1998 | Fry et al. | 141/347 |

(Continued)

FOREIGN PATENT DOCUMENTS

| | | |
|---|---|---|
| EP | 39977 A1 | 11/1981 |
| EP | 0122404 B1 | 10/1984 |

(Continued)

OTHER PUBLICATIONS

Machine generated English translation of EP0122404, presented by the applicant.*

*Primary Examiner* — Timothy L Maust
(74) *Attorney, Agent, or Firm* — Andrew Wilford

(57) ABSTRACT

A fuel hose nozzle for filling a tank having a filler the tank with liquefied petroleum gas has a tubular valve housing extending along an axis and having an outer end, a tubular valve guide axially shiftable in the valve housing between a front position and a rear position and forming an outlet port adjacent the outer end, and a valve in the housing movable between an open position permitting fluid flow into the valve guide toward the outlet end and a closed position preventing such flow. A valve piston in the valve guide and axially fixed in the valve housing is engaged in the front position of the valve guide with the port to block flow through same. A fitting sleeve surrounding and axially shiftable on the valve housing has at the outer end an end fitting complementary to the tank filler neck.

10 Claims, 6 Drawing Sheets

(56) References Cited

U.S. PATENT DOCUMENTS

| | | | | |
|---|---|---|---|---|
| 6,843,285 | B2 * | 1/2005 | Ozawa | 141/326 |
| 7,543,611 | B2 * | 6/2009 | Kallberg | 141/1 |
| 7,621,304 | B2 * | 11/2009 | Nielsen | 141/351 |
| 8,033,305 | B2 * | 10/2011 | Weh et al. | 141/218 |
| 8,113,240 | B2 * | 2/2012 | Blanchard et al. | 137/630.14 |
| 8,316,900 | B2 * | 11/2012 | Hemingway | 141/349 |
| 2003/0178096 | A1 | 9/2003 | Lacroix et al. | |
| 2007/0155224 | A1 | 7/2007 | Marot et al. | |
| 2012/0132294 | A1 * | 5/2012 | Hoffman et al. | 137/383 |

FOREIGN PATENT DOCUMENTS

| | | | |
|---|---|---|---|
| EP | 1006310 | A2 | 11/1999 |
| EP | 1236678 | A1 | 9/2002 |
| EP | 1437543 | A1 | 7/2004 |

* cited by examiner

HOSE FUEL NOZZLE

FIELD OF THE INVENTION

The present invention relates to a hose fuel nozzle. More particularly this invention concerns such a nozzle for filing a tank with liquid petroleum gas.

BACKGROUND OF THE INVENTION

A fuel hose nozzle for filling a tank of, preferably, a motor vehicle with liquid fuel, in particular for filling tanks of motor vehicles with liquefied petroleum gas has a valve and an end fitting adapted to fit with the filler neck of the tank being filled. Liquefied petroleum gas here means, in particular, propane, butane and other mixtures. Manually operated fuel hose nozzles are normally used for filling fuel tanks with liquefied petroleum gas; these nozzles are connected to the tank filler neck in such a way that they are sealed against liquid and gas leakages.

There is no uniformly standardized fitting between fuel hose nozzles, on the one hand, and tank filler necks on the other hand. This is the reason why to date variously configured fuel hose nozzles with different connection fittings have been manufactured. In Europe, for example, there are three different coupling types or fittings that are not compatible with each other: namely, the ACME 1¾" screw thread, the Italian DISH claw coupling and the bayonet coupling. The EURO coupling that is standardized according to EN 13760 is introduced as a fourth type of coupling or fitting between fuel hose nozzle and tank filler neck, and is not compatible with the other three types of couplings or fittings. Manufacture and testing of the differently configured fuel hose nozzles that accommodate the various fittings is complex and associated with undesired requirements. These differently configured fuel hose nozzles must usually also be operated in different ways, which may result in operating errors, thereby causing safety concerns. This is a critical issue, in particular, because in many countries the drivers of the motor vehicles must handle the filling of their fuel tanks themselves. Known fuel hose nozzles have the further disadvantage that, after suffering mechanical damage, in particular to the valve insert, they no longer provide sufficient sealing tightness. Moreover, when the fuel hose nozzle is detached from the tank filler neck, often the quantities of liquefied petroleum gas that can escape in the environment are quite voluminous.

OBJECTS OF THE INVENTION

It is therefore an object of the present invention to provide an improved hose fuel nozzle.

Another object is the provision of such an improved hose fuel nozzle that overcomes the above-given disadvantages, in particular that can work with a number of different tanks.

A further object is to provide a modular system for use with different tank filler necks.

SUMMARY OF THE INVENTION

A fuel hose nozzle for filling a tank having a filler the tank with liquefied petroleum gas has according to the invention a tubular valve housing extending along an axis and having an outer end, a tubular valve guide axially shiftable in the valve housing between a front position and a rear position and forming an outlet port adjacent the outer end, and a valve in the housing movable between an open position permitting fluid flow into the valve guide toward the outlet end and a closed position preventing such flow. A valve piston in the valve guide and axially fixed in the valve housing is engaged in the front position of the valve guide with the port to block flow through same. A fitting sleeve surrounding and axially shiftable on the valve housing has at the outer end an end fitting complementary to the tank filler neck. The valve guide and fitting sleeve are relatively so oriented that, in the front position of the valve guide and when the fitting sleeve is fitted with the tank filler neck, the tank filler neck axially touches or is axially closely juxtaposed with the valve guide. An actuating lever coupled to the fitting sleeve and to the valve is operable to pull the fitting sleeve rearward on the valve housing out of the front position and open the valve so that, when the fitting sleeve is fitted with the tank filler neck, rearward movement of the fitting sleeve on the valve housing pushes the valve guide rearward out of sealing engagement with the piston head.

Thus according to the invention, when the valve guide is pressed against the seal ring of the tank filler neck, the valve guide is displaced relative to the valve piston. The valve piston will then open the outlet port of the valve guide. When the valve guide is pressed against the seal ring of the tank filler neck according to one embodiment the invention, the valve guide or a front end of the valve guide is pressed directly against the seal ring of the tank filler neck. According to another embodiment of the invention it is also possible, however, for the valve guide to be pressed against the seal ring of the tank filler neck via an intermediate piece as described further below. In this instance, the valve guide supports itself via an intermediate piece against the seal ring of the tank filler neck. It falls within the scope of the invention that a seal ring is necessarily required for the valve guide or the pressing action of the valve guide against a seal ring in order to dispense liquefied petroleum gas. It is self-understood, furthermore, that the operating handle is envisioned for opening and closing of the valve or the fuel hose nozzle. The term "in the connected position" as used below means the connected or properly connected position of the fuel hose nozzle with the tank filler neck.

The invention is based on the discovery that identically configured or substantially identically configured valves can be equipped with different end fittings. Insofar, it is recommended that the fuel hose nozzle according to the invention is characterized by its modular construction. It is advantageous that with different end fittings the operation of the valve is still identical or substantially identical. The end fittings that are placed on the valve have one of the fittings as referred to above.

According to an especially preferred embodiment according to the invention the end fitting is configured as a fitting sleeve that encloses the tank filler neck or the valve insert at least in part. It is recommended that the operating handle engage with the fitting sleeve when the handle is operated resulting in relative displacement of the fitting sleeve and valve guide longitudinally of the valve guide or the fitting sleeve. It is advantageous for the valve guide to be completely or substantially completely enclosed with regard to its longitudinal extension by the fitting sleeve. When the fuel hose nozzle is not yet connected to a tank filler neck, operation of the handle will preferably cause the fitting sleeve to be pulled toward the rear against the dispensing direction of the liquefied petroleum gas relative to the tubular housing. When the fuel hose nozzle is already connected with a tank filler neck, the fitting sleeve advantageously supports itself on the tank filler neck when the operating handle is operated, and the valve guide is pressed against the seal ring of the tank filler neck so that dispensing of the liquefied petroleum gas can take place thereafter.

According to proven embodiments according to the invention the operating handle is configured as an actuation lever that can be pivoted around an axis. It is recommended that the actuation lever comprise a stop element that delimits the pivoting motion of the actuation lever as well as the relative displacement between valve guide and fitting sleeve.

It falls within the scope of the invention that, when the fuel hose nozzle is connected to a tank filler neck, the valve guide is pressed against a seal ring of the tank filler neck when the actuation lever is operated and when relative displacement of the valve guide and the fitting sleeve occur, resulting in opening of the outlet port of the valve guide. It falls furthermore within the scope of the invention that, when the fuel hose nozzle is not connected to the tank filler neck, the fitting sleeve is displaceable against the outward flow direction of the liquefied petroleum gas when the actuation lever is operated, but wherein it is not possible for the valve guide to be displaced relative to the valve piston due to a lack of a seal ring, which means dispensing of the liquefied petroleum gas is not possible.

An especially preferred embodiment according to the invention is characterized in that the valve piston has a head, and the head rests in the closed position of the valve or the fuel hose nozzle against a seat that extends around the outlet port of the valve guide and thereby closes the outlet port. It is advantageous for the head to become freed from the seat during relative displacement of the valve guide and the valve piston, so that the outlet port is open and the liquefied petroleum gas can flow out of the outlet port. It is recommended that the head comprise a valve seal extending around it and bearing in the closed position of the valve advantageously against the seat of the outlet port. This valve seal acts in the intact condition of the valve as the main seal of the valve. The intact condition of the valve means, in particular, the condition of the valve in which the valve piston is undamaged and the head closes the outlet port of the valve guide when the valve is in its closed position. During a closing movement or the change-over to the closed position the head must, moreover, displace a certain volume of liquid in the area of the outlet port, which means it is advantageous for the valve piston to be hydraulically damped into this closing motion.

An especially preferred embodiment according to the invention is characterized in that in the closed position of the valve an upstream seal is provided between the valve guide and the tubular housing or between the valve guide and a valve housing that is secured to the tubular housing, to provide a seal against the inflow of liquefied petroleum gas from the tubular housing toward the outlet port of the valve guide. The valve housing is advantageously screwed into the tubular housing. It falls within the scope of the invention that the upstream seal extends around the valve guide. This upstream seal can be a seal ring or even a seal disk. In fact, with the assistance of the preferred upstream seal, double sealing action is achieved in the closed position of the fuel hose nozzle. On the other hand, the valve piston or its head closes the outlet port of the valve guide, and a valve seal that advantageously extends around the valve piston or around its head is preferred. On the other hand, in the closed position of the valve the upstream seal is provided is between the valve guide and the tubular housing or between the valve guide and the valve housing that is secured to the tubular housing providing a seal against the inflow of liquefied petroleum gas from the tubular housing into a dispensing chamber of the valve guide that is provided upstream of the outlet port. This upstream seal ensures in an advantageous manner that, in the event of mechanical damage to the valve, a seal is nevertheless in place against the uncontrolled escape of liquefied petroleum gas. Especially if the valve piston breaks, in particular in the area of its head, the sealing action relative to the outlet port of the valve guide provided by the head is no longer ensured, and the relatively minimal quantity of liquefied petroleum gas located in the dispensing chamber upstream of the outlet port is able to escape. However, the upstream seal between the valve guide and the tubular housing or valve housing prevents the inflow of further liquefied petroleum gas into the dispensing chamber of the valve guide, in this case taking over the task of functioning as main seal.

According to a very preferred embodiment according to the invention a spring is provided that presses the valve guide toward the outlet end of the fuel hose nozzle. In the embodiment as described above this ensures that in the closed position of the fuel hose nozzle the upstream seal is always provided between the valve guide and the tubular housing or between the valve guide and the valve housing. This way, even if the valve piston breaks, effective sealing action will always be retained in order to prevent any liquefied petroleum gas from escaping. The spring element is preferably configured as a coil spring and within the scope of the invention the spring or the coil spring acts is a compression spring. According to one variant of the embodiment the upstream seal is held in a seal seat or a seat groove of the valve guide, and it falls within the scope of the invention that this upstream seal shall extend around the valve guide.

A further variant of the embodiment according to the invention is characterized in that the upstream seal is provided in the valve such that in the closed and intact condition of the valve the tubular housing is in fluid communication with the outlet port or the dispensing chamber, closed by the valve piston, that is permeable for liquefied petroleum gas. In this variant of an embodiment the upstream seal in fact does not take over any sealing function between the tubular housing and the outlet port or dispensing chamber when the valve is in the closed and intact condition. Advantageously, the upstream seal extends around the valve guide in this embodiment as well. It falls within the scope of the invention that the upstream seal is provided upstream of the front end of the valve housing that is turned away from the outlet port such that in the closed position and intact condition of the valve the tubular housing is in fluid communication for liquefied petroleum gas with the outlet port or the dispensing chamber, which is closed by the valve piston. Preferably, a spring is provided in this variant of an embodiment as well, the spring being configured as a coil spring that presses the valve guide toward the outlet end of the fuel hose nozzle. In this context it is advantageous for the valve guide to be biased against the valve piston or the head. Preferably, if the valve piston breaks, in particular in the area of its head, under the action of the spring element the valve guide is pushed or pressed into a position in which the upstream seal seals against the inflow of liquefied petroleum gas from the tubular housing toward the outlet port of the valve guide. If the head or a part of the valve piston with the head breaks off, the sealing action with regard to the outlet port of the valve guide is no longer ensured, and the valve guide is no longer able to support itself against the head. The consequence is that, under action of the spring element, the valve guide is pressed toward the outlet end of the fuel hose nozzle and, simultaneously, the upstream seal is brought into a position in which seals between the tubular housing and the dispensing chamber. According to one embodiment the upstream seal is configured as a seal disk resting tightly against the valve housing. According to another embodiment the upstream seal is pushed into a sealing position in which it is provided between the tubular housing and valve guide or preferably between the valve housing and the valve guide.

According to a first preferred embodiment of the invention the end fitting or the fitting sleeve has a screw thread as fitting formation on the connection side, and this screw thread can be screwed onto the tank filler neck with a complementary screw thread by way of complementary fitting formation. The connection-side screw thread is advantageously configured as an internal thread, and the internal thread can be screwed on an external thread on the tank filler neck. It is recommended for these fittings to be an ACME 1¾" screw thread.

According to a second preferred embodiment of the invention the end fitting or the fitting sleeve has a bayonet closure element as fitting formation on the connection side, and a complementary bayonet closure element can be connected to the tank filler neck by way of a complementary fitting. If falls within the scope of the invention that the bayonet closure element on the connection side is, in the usual manner, a longitudinal slot with subsequent cross slot, and the complementary bayonet closure element of the tank filler neck is a complementary pin that can be inserted in the usual manner into the longitudinal slot and subsequently in the cross slot.

According to a third preferred embodiment of the invention the end fitting or the fitting sleeve has at its connection side radially and outwardly extendable or unfoldable connection claws, and in the connected position of the fuel hose nozzle the claws engage behind a connection collar on the tank filler neck. In this instance, the connection claws constitute in fact essentially the fitting formation of the end fitting, and the connection collar constitutes essentially a complementary fitting formation on the tank filler neck. Preferably, the fittings are configured in accordance with the Italian claw coupling DISH. It falls within the scope of the invention that, upon operation of the operating handle or actuation lever, the connection claws are radially and outwardly extended/unfolded. The connection collar of the tank filler neck extends preferably on the inside around a cylinder-shaped projection of the tank filler neck. The connection claws that engage behind the connection collar of the tank filler neck in the closed position advantageously constitute the seal ring for the valve guide when the valve is opened. The configuration of the fitting as described above allows for opening the valve only if the appropriate connection between the end fitting and the tank filler neck has been made. If the fuel hose nozzle is placed in such a way that it catches on the edge of the tank filler neck, the radial outward extension is not possible. According to the invention, in such a case the connecting claws block any relative displacement of the valve guide relative to the valve piston. Consequently, no dispensing of the liquefied petroleum gas is possible.

According to a fourth preferred embodiment of the invention the end fitting or the fitting sleeve has on the connection side catch balls that are distributed around the end fitting, and the catch balls engage in a catch groove of the tank filler neck when the fuel hose nozzle is in the closed position. The catch balls thus essentially constitute the fitting formation of the end fitting and the catch groove essentially constitutes the complementary fitting formation of the tank filler neck. It falls within the scope of the invention that the catch balls can snap in place in the catch groove upon operation of the operating handle or actuation lever. If further falls within the scope of the invention that the fitting described above corresponds to the standardized EURO connectors as outlined above.

According to a preferred embodiment of the invention the end fitting or the fitting sleeve can be rotated relative to the tubular housing. The end fitting or the fitting sleeve is advantageously rotatable around the longitudinal axis of the tubular housing or around the longitudinal axis of the valve insert. It falls within the scope of the invention that the rotatability of the end fitting is realized, in particular, with the coupling type that involves a screw thread and the coupling type that involves the bayonet closure.

A proven embodiment according to the invention is characterized in that on the connection side of the end fitting or the fitting sleeve there is provided at least one intermediate piece, and the intermediate piece is displaceable longitudinally or axially of the end fitting or the tubular housing, and the valve guide is able to brace itself in the connected position via this intermediate piece against the seal ring of the tank filler neck. It has been described previously that the valve guide is able to brace itself, on the one hand, directly against the seal ring of the tank filler neck in the connected position of the fuel hose nozzle. On the other hand, the valve guide is also able to brace itself against the seal ring of the tank filler neck via the above-described intermediate piece. The axial displaceability of the intermediate piece serves to ensure that, due to the displaceability of the intermediate piece, the valve guide will not engage a seal ring in the intermediate piece when the fuel hose nozzle is not connected, so that liquefied petroleum gas cannot be dispensed in the disconnected position.

In order to achieve the object the invention further provides a modular system having a valve and a plurality of end fittings, and the valve has an operating handle and a valve insert, and each end fitting can be connected with a fitting of a tank filler neck that is complementary to the end fitting, and the one valve can optionally be combined with one of the end fittings. It falls within the scope of the invention that fuel hose nozzles that are substantially identically designed and identically operated or that are essentially identically configured or essentially identically activated can be combined with different end fittings.

The invention is therefore based on the discovery that fuel hose nozzles or valves of one given model and one given type of operation can be easily combined with different fittings or end fittings. The similarity of the configuration of the valves considerably reduces any involved complexity in the areas of manufacture, testing and repair of the fuel hose nozzles. Since drivers will consistently encounter the same operating functions on the fuel hose nozzles according to the invention, it is possible to considerably reduce or minimize operating errors that may result in safety hazards. The fuel hose nozzles according to the invention are characterized further by their simple and functionally reliable coupling with the tank filler neck. At the same time, a surprisingly tight seal is ensured, first in the event of mechanical damage to the fuel hose nozzle, in particular if the valve piston breaks, it is possible to maintain a functionally reliable sealing action of the valve. Due to the construction of the fuel hose nozzle, it is possible to especially minimize the amount of liquefied petroleum gas that escapes from the tank filler neck when the fuel hose nozzle is detached. When disengaging the coupling between the fuel hose nozzle and the tank filler neck, it is possible to release quantities less than 1 $cm^3$. The special configuration of the outlet port of the valve guide that was described above and the head that is held therein allows for an advantageous hydraulic damping of the valve piston when the fuel hose nozzle is closed because the valve piston or the head must displace liquid into the valve guide. To be noted as well is the fact that the fuel hose nozzle according to the invention can be manufactured at relatively low costs.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
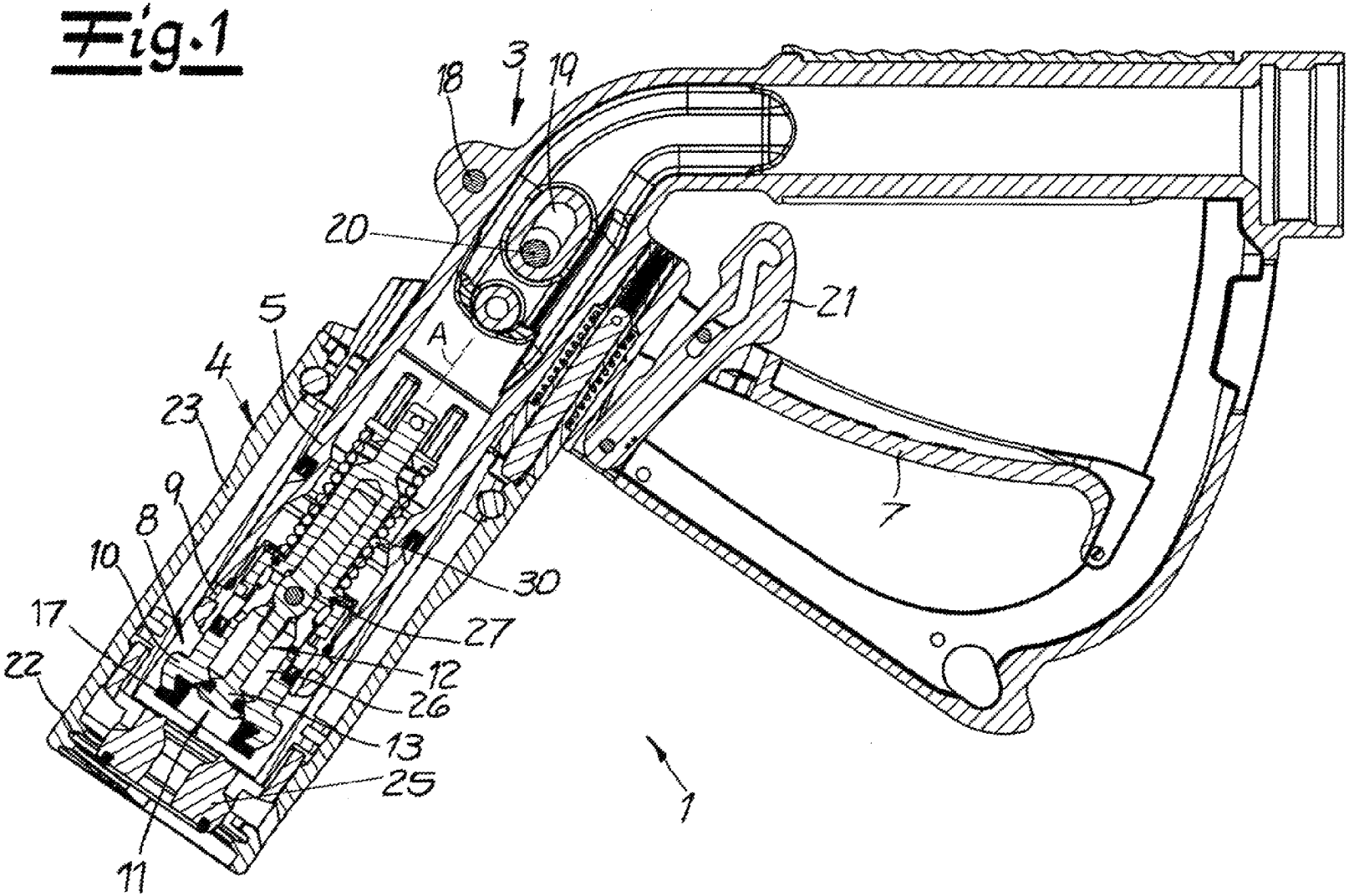
FIG. 1 is a section through a fuel hose nozzle having a screw thread fitting in the closed position.
Figure 2:
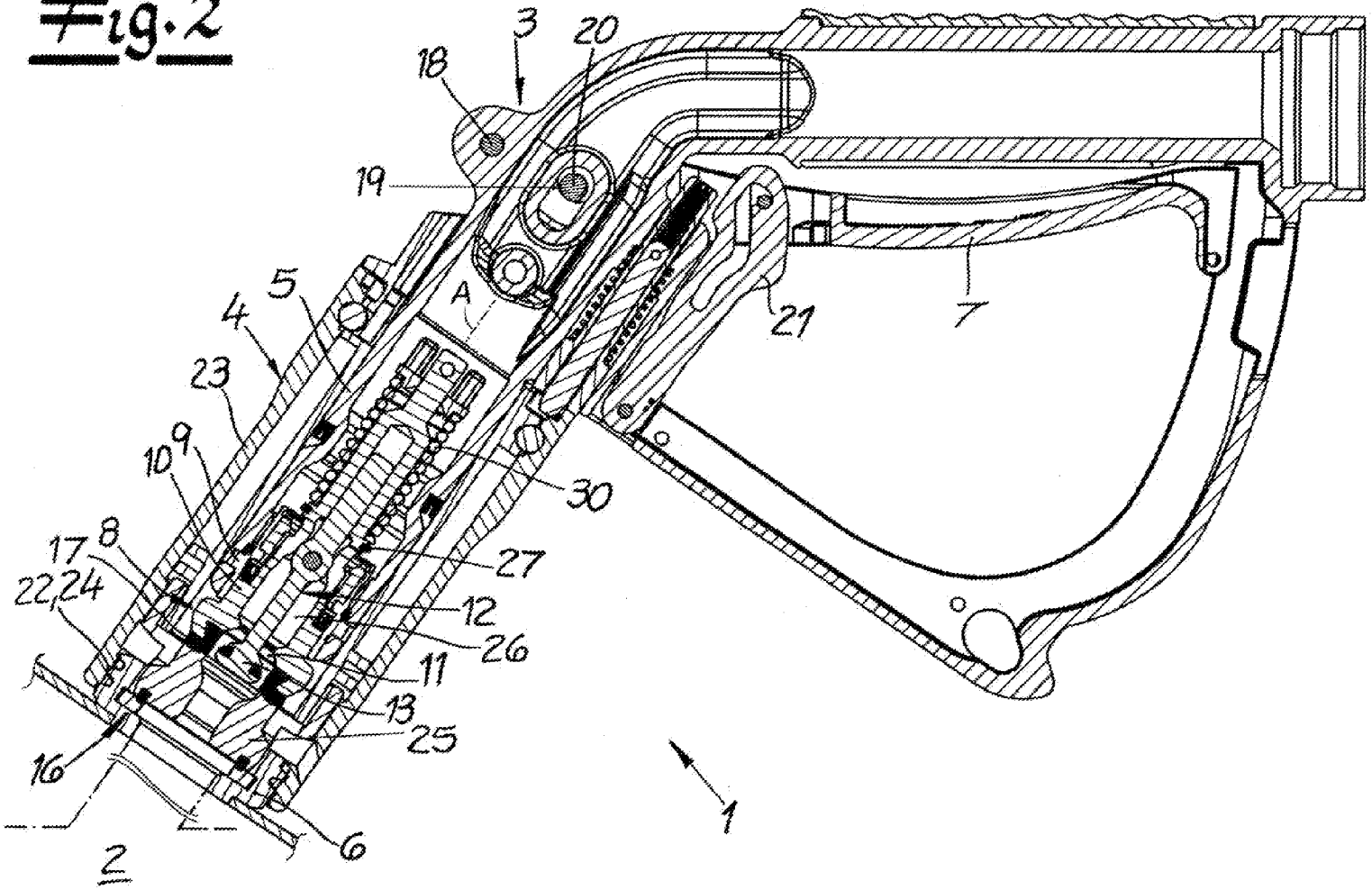
FIG. 2 shows the nozzle of FIG. 1 in the open position.
Figure 3:
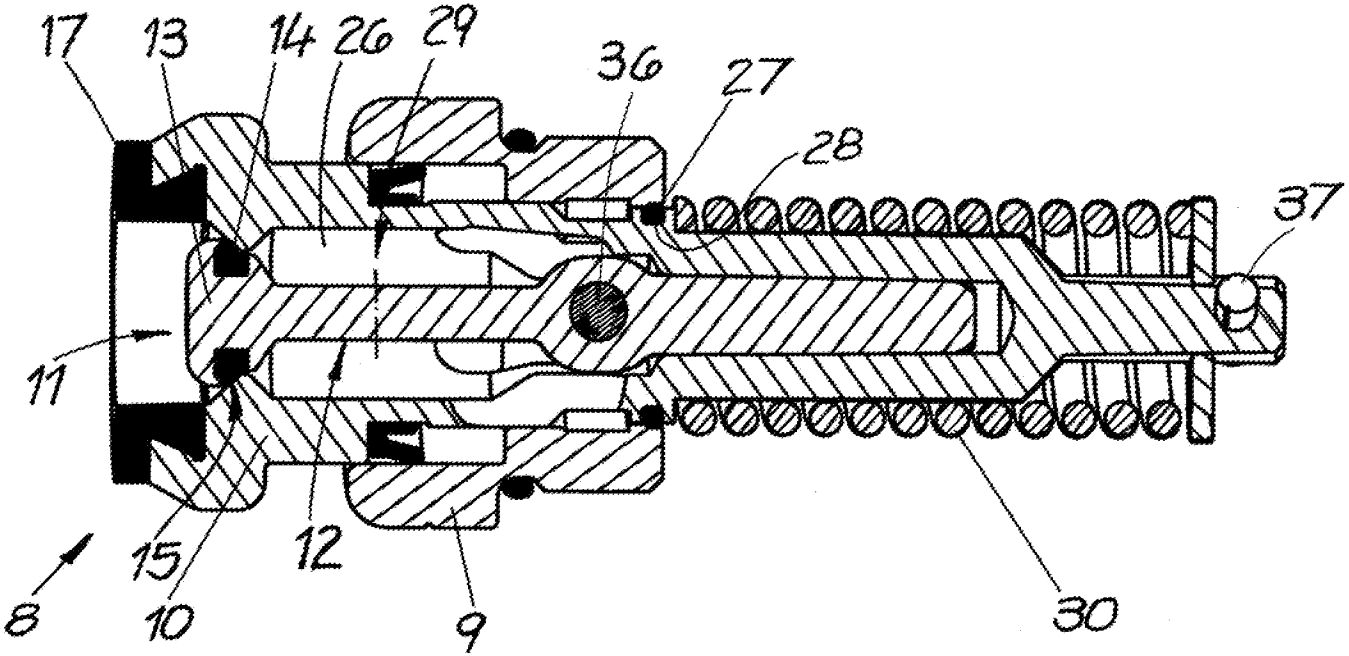
FIG. 3 is a large-scale view of a valve insert in the position of FIG. 1.

As seen in FIGS. 1-3 a fuel hose nozzle 1 for feeding liquefied petroleum gas into a tank 2 of a motor vehicle has a valve 3 and an end fitting mounted on the outlet end of the valve 3. In the embodiment according to the figures the end fitting has a fitting sleeve 4 that fits around a front end of the tubular housing 5 of the valve 3. The fitting sleeve 4 can be connected with a complementary fitting of a tank filler neck 6 that is complementary to the formations of the fitting sleeve 4. The valve 3 has, aside from the tubular housing 5, an operating handle or lever 7 as well as a valve insert 8 in the front end of the tubular housing 5. In the embodiment according to the figures, a valve housing 9 is fixed, preferably screwed, to the tubular housing 5. A valve guide 10 is displaceable along an axis A of this valve housing 9. The valve guide 10 has an outlet port 11 for dispensing the liquefied petroleum gas. A valve piston 12 held in the valve guide 10 and anchored by a crosswise pin 36 to the housing 5 closes, when the valve 3 is in the closed position (FIG. 1 and FIGS. 3 to 6), the outlet port 11 of valve guide 10 with a head 13. Here, the piston head 13 is fitted with a seal ring 14 that engages in the closed position of the valve 3 a seat 15 in the outlet port 11 of the valve guide 10, thus providing a fluid-proof closure of the outlet port 11.

The valve guide 10 is displaceable longitudinally or axially relative to the valve piston 12. The valve guide 10 also has on its front end turned toward the tank a pressure seal 17 that extends annularly around the valve guide 10. When pressing the valve guide 10 or the pressure seal 17 against a seal ring 16 of a tank filler neck 6, the valve guide 10 is pressed rearward relative to the valve piston 12, such that the piston head 13 lifts off the seat 15, and liquefied petroleum gas can be dispensed through the outlet port 11 of the valve guide 10. This open position of the fuel hose nozzle 3 is shown in FIG. 2.

The fuel valve 3 is opened by pivoting the actuation lever 7 from the position shown, for example, in FIG. 1 to the position shown in FIG. 2. The actuation lever 7 is here pivotable about an axis 18. Preferably, and shown in the embodiment, the actuation lever 7 also has a stop pin 20 that is guided inside a slot 19 that limits pivoting of the actuation lever 7. The actuation lever 7, moreover, acts in conjunction with a hold-open latch pawl 21 that makes it possible to operate the fuel hose nozzle 1 easily with only one hand. The actuation lever 7 entrains the fitting sleeve 4 and, when the actuation lever 7 is pivoted from its closed position (FIGS. 1 and 4 to 6) into its open position (FIG. 2), the actuation lever 7 simultaneously pulls the fitting sleeve rearward, in particular opposite the flow direction of the liquefied petroleum gas. When the fuel hose nozzle is connected to the tank filler neck 6, the valve guide 10 is pressed against the seal ring 16 of the tank filler neck 6 to push the valve guide 10 rearward relative to valve piston 12. This way, the outlet port 11 of the valve guide 10 is opened to dispense the liquefied petroleum gas. But if the nozzle 1 is not connected to the tank filler neck 6, pivoting of the actuation lever 7 only pulls back the sleeve 4. Since the valve guide 10 is pressed against a seal ring 16 in this case, the outlet port 11 remains closed and dispensing of the liquefied petroleum gas is not possible.

In the embodiment of FIGS. 1 and 2 the fitting sleeve 4 has a screw thread that is an internal thread 22 forming the fitting formation. By rotating an outer jacket 23 of the fitting sleeve 4 relative to the tubular housing 5 it is possible to screw the internal thread 22 of the fitting sleeve 4 down onto a complementary outside thread 24 of the tank filler neck 6. This screwed-on or screwed-in position is shown in FIG. 2. When pivoting the actuation lever 7 into the open position of FIG. 2, the lever pull back the fitting sleeve 4 and, because of the engagement with the tank filler neck, the valve guide 10 is pushed downstream toward the tank filler neck 6. In the embodiment of FIG. 2 the valve guide 10 does not directly engage the seal ring 16 of tank filler neck 6. Rather, the seal 17 of the valve guide 10 pushes against an intermediate piece 25 that in turn is braced in the connected position on the seal ring 16 against the tank filler neck 6. This causes the valve guide 10 to be moved rearward relative to the valve piston 12, and the outlet port 11 is opened for dispensing the liquefied petroleum gas. The intermediate piece 25 held at the connection-side end of fitting sleeve 4 is, furthermore, displaceable longitudinally or axially of the fitting sleeve 4. When it is not connected with the tank filler neck 6 (FIG. 1), the fitting sleeve 4 is pulled rearward when the actuation lever 7 is pivoted into the closed position. The pressure seal 17 of the valve guide 10 is braced against the intermediate piece 25. But, due to the axial displaceability of this intermediate piece 25, the valve guide 10 is not able to engage the seal ring 16 that is necessary for the dispensing of the liquefied petroleum gas. In this way, any inadvertent or uncontrolled dispensing of liquefied petroleum gas is avoided when the fuel hose nozzle 1 is in the unconnected position. The fittings as shown in FIGS. 1 and 2, moreover, correspond to the type of a coupling with an ACME screw thread.

In the open position of the valve 3 liquefied petroleum gas is able to exit through the tubular housing 5 into the dispensing chamber 26 of the valve guide 10 upstream of the outlet port 11. But in the closed position of the valve 3 (see especially FIGS. 1 and 3) an upstream seal 27 between the valve guide 10 and the valve housing 9 seals the dispensing chamber 26 relative to the interior of the tubular housing 5. In the illustrated embodiment the upstream seal 27 is in a groove 28 of the valve guide 10. Here, the upstream seal 27 is a gland ring. But the upstream seal 27 can also be configured a disk. In the context of the invention the upstream seal 27 is of special significance. It ensures that even in the event of mechanical damage to the fuel hose nozzle 1 the valve 3 will not leak. In particular, if the valve piston 12 breaks, for instance at a location 29, the head 13 is no longer able to seal the outlet port 11 of the valve guide 10. The relatively minimal quantity of liquefied petroleum gas that is in the dispensing chamber 26 would escape through the outlet port 11. But the upstream seal 27 prevents any further escape of liquefied petroleum gas from the tubular housing 5 via the dispensing chamber 26 and outlet port 11. The upstream seal 27 thus assumes the function of the main seal. A pressure spring 30 braced rearwardly against a pin 37 anchored in the tubular housing 6 biases the valve guide 10 (see especially FIG. 3) forwardly ensures that the valve guide 10 will remain in its front closed or sealing position.

Thus according to the invention the nozzle of this invention has, in effect, two valves. The upstream valve is formed by the seal 27 and allows liquid to flow from upstream into the chamber 26, whence it can flow out through the downstream valve formed by the piston head 13 and seat 15. When the fitting formation 22 of the sleeve 4 is screwed to the filler neck 6, this neck 6 pushes back the ring 25 so that it engages or is closely juxtaposed with the valve guide 10, without, however, pushing it back against the spring 30 off the axially fixed piston 12. Pulling back the lever 7, which is coupled by an unillustrated linkage to the sleeve 4, pulls back the sleeve 4 and presses the ring 25 back against the valve guide 10, shifting it backward out of its front closed position relative to the piston 12 and to the valve housing sleeve 9 fixed in the nozzle housing 5, with the effect of simultaneously opening both valves. Thus, pulling back the lever not only shifts back the guide 10 to pull it off the piston head 13, but also pushes the seal 27 back past the sleeve 9 so that gas under pressure can flow into the chamber 26 and out of the port 14 into the filler neck 6 of the tank 2. If the piston 12 is broken, the valve formed by the seal 27 will still work, preventing emission of gas because of the redundant valve assembly.

Figure 4:
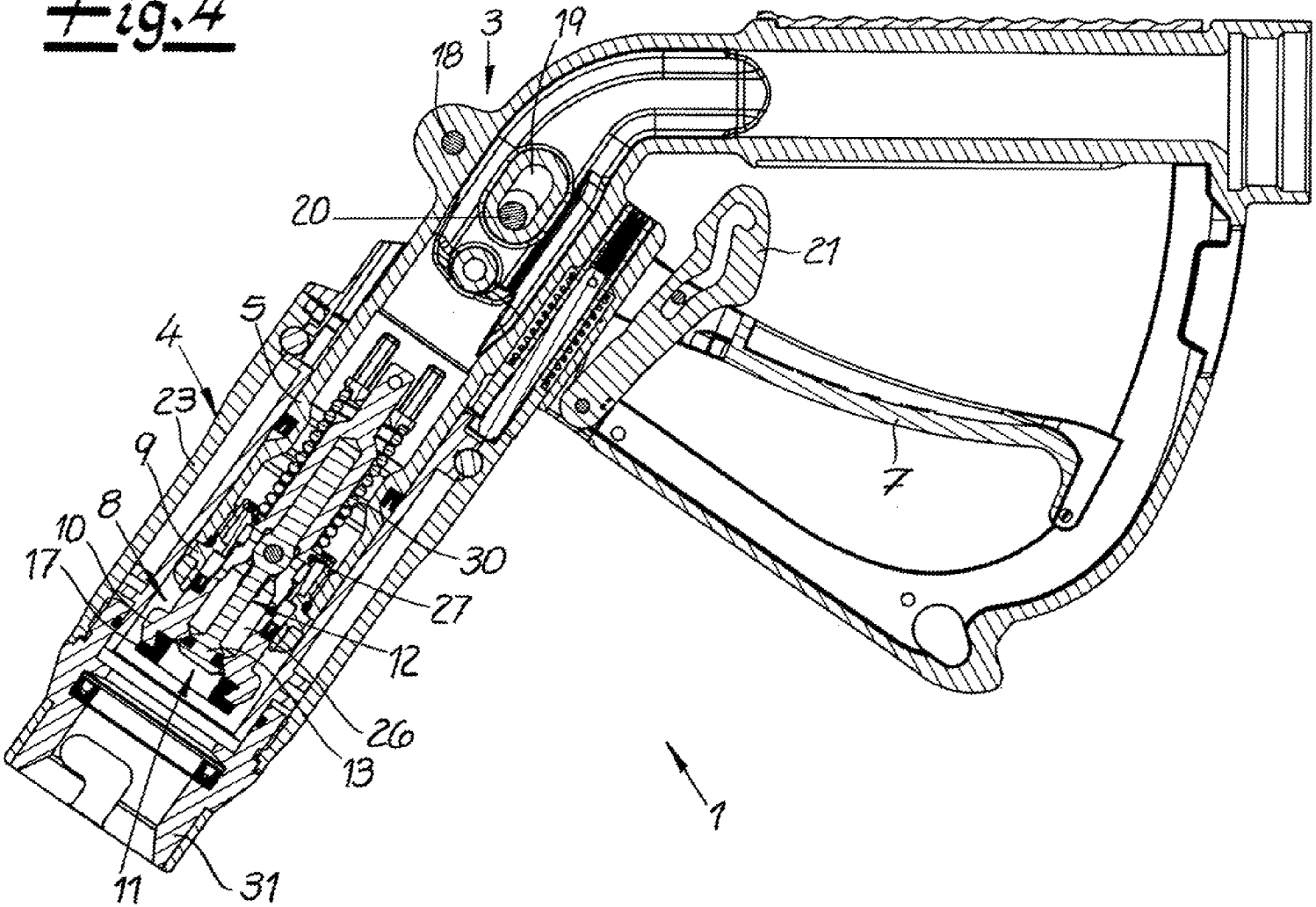
FIG. 4 is a section of a fuel hose nozzle according to the invention with a bayonet fitting in the closed position.

FIG. 4 shows another embodiment of the fuel hose nozzle 1 according to the invention. Here, the fitting sleeve 4 has a bayonet closure element 31 as a fitting formation on the connection side that can be connected to a complementary bayonet closure formation of the tank filler neck 6 configured as a pin or peg but not shown here. In this embodiment as well, the outer jacket 23 of fitting sleeve 4 for establishing the bayonet coupling relative to the tubular housing 5 can be rotated. The operation of this embodiment is basically identical to that of the fuel hose nozzle 1 of FIGS. 1 and 2. In the connected position with the tank filler neck 6, when the actuation lever 7 is operated or pivoted, the fitting sleeve 4 is retracted and the valve guide 10 is pushed against a seal ring 16 of the tank filler neck 6 for dispensing the liquefied petroleum gas, as described above. In the embodiment of FIG. 4 it is also possible for the valve guide 10 to support itself via an intermediate piece 25, not shown here, against the seal ring 16 of the tank filler neck 6.

Figure 5:
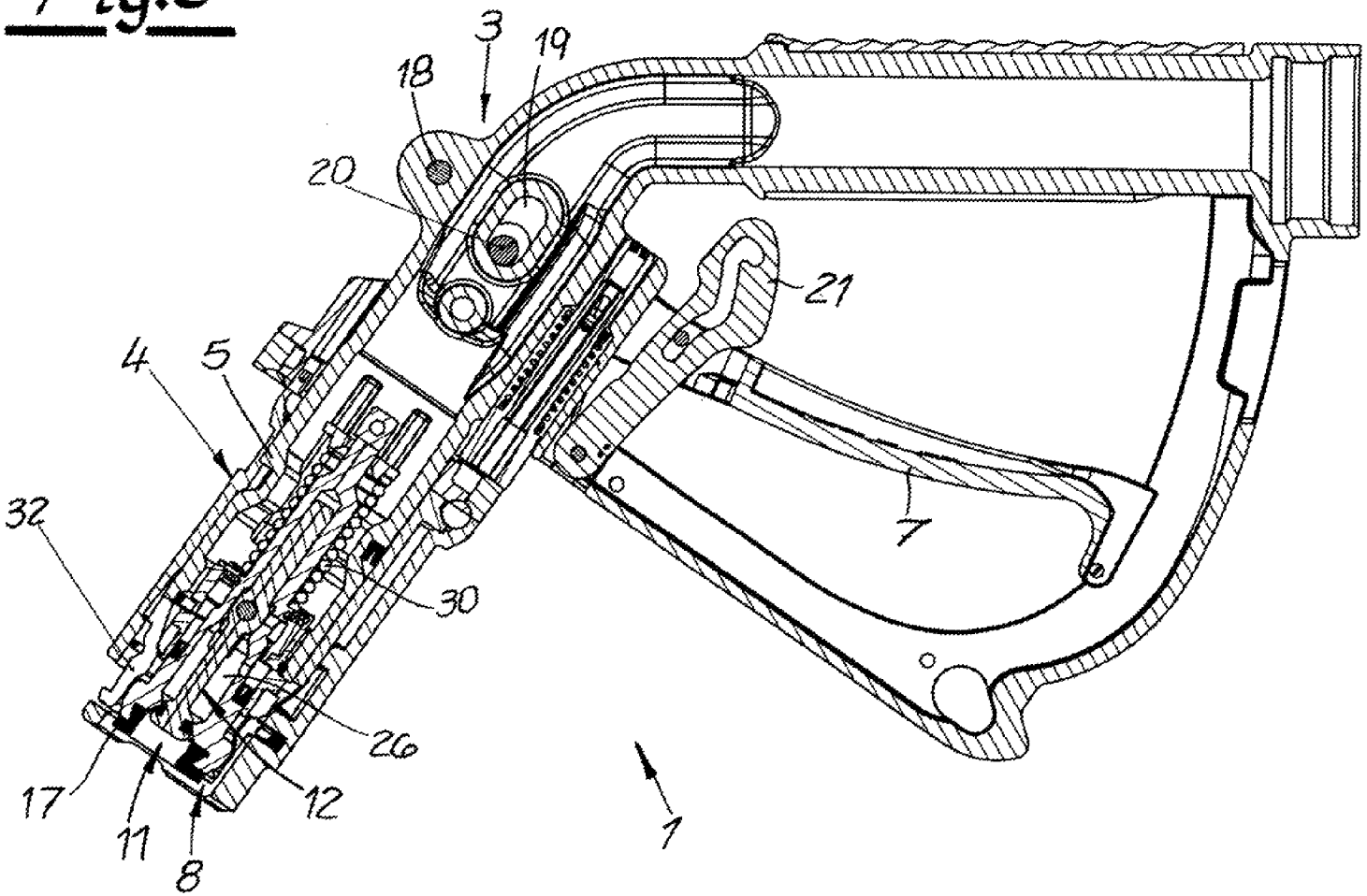
FIG. 5 shows the valve of to FIG. 4 with a claw fitting.

In the embodiment of FIG. 5 the fitting sleeve 4 is configured for a so-called Italian claw coupling. A plurality of connection claws 32 is distributed over the outer surface of the fitting sleeve 4 on the connection-side end of the fitting sleeve 4. When the actuation lever 7 is operated or pivoted, it in turn pulls on the fitting sleeve 4, thereby radially and outwardly extending the connection claws 32. These connection claws 32, which constitute the fitting formations of the fitting sleeve 4, grasp in the connected position of the fuel hose nozzle 1 behind an unillustrated connection collar of a complementary fitting of the tank filler neck 6. When the connection claws 32 rest against the connection collar, the valve guide 10 engages the required seal ring 16, so that in this case as well liquefied petroleum gas can only be dispensed in the connected position of the fuel hose nozzle 1.

Figure 6:
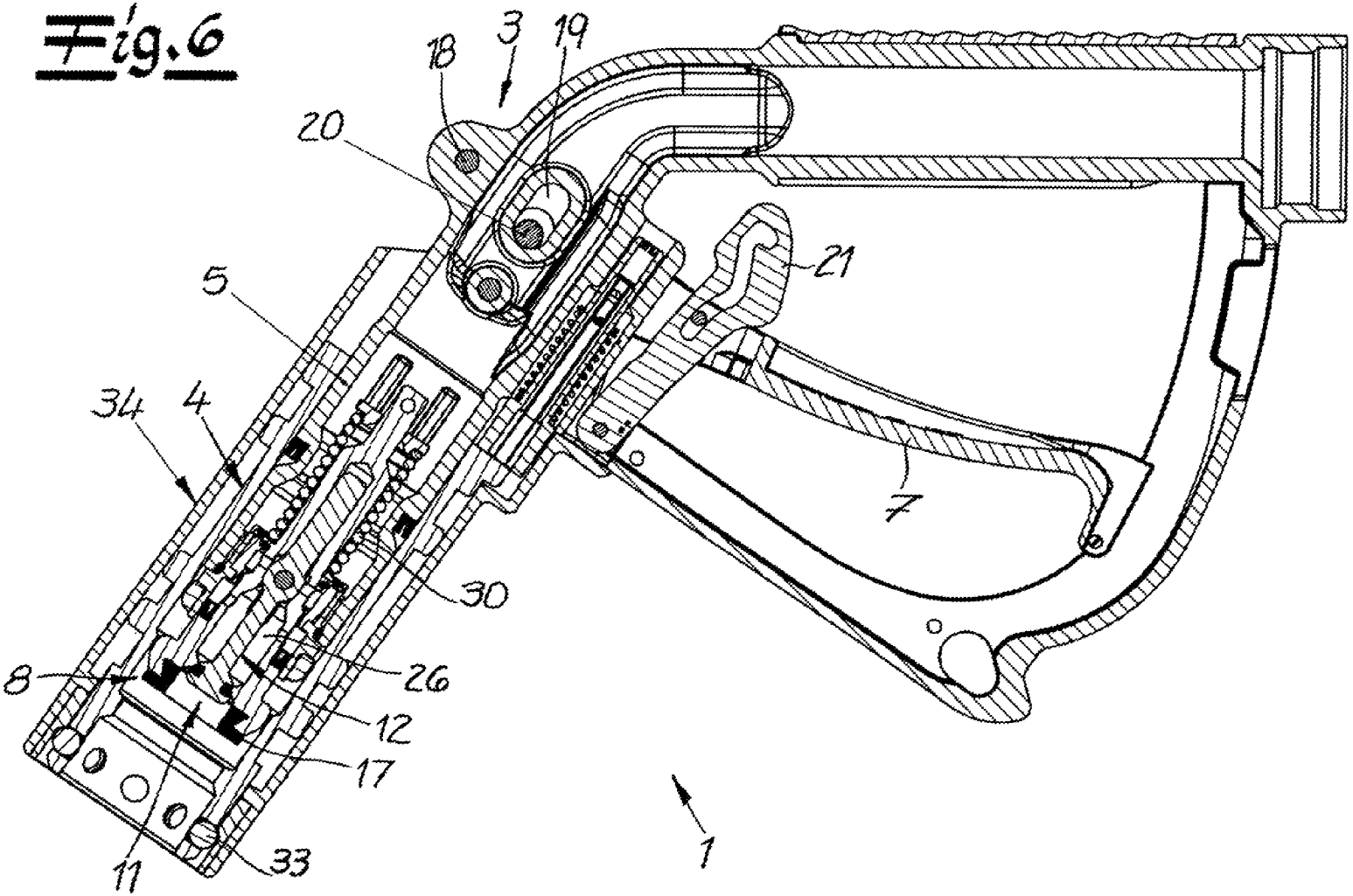
FIG. 6 shows the valve of FIG. 4 with a ball-type catch fitting.

In the embodiment of the fuel hose nozzle 1 of FIG. 6 the fitting sleeve is configured in accordance with a EURO connector according to EN 13760. The fitting of the sleeve 4 is constituted essentially by catch balls 33 distributed angularly around the connection-side end of the fitting sleeve 4. In the connected position of the fuel hose nozzle 1 these catch balls 33 engage in an unillustrated catch groove forming a complementary fitting formation of the tank filler neck 6. The snap-in action of the catch balls 33 in the catch groove of the tank filler neck 6 is effected by operating or pivoting the actuation lever 7 to engage or pull the fitting sleeve 4 for this purpose. The valve guide 10 is only able to engage the seal ring 16 in the connected and snapped-in position, so dispensing of the liquefied petroleum gas is only then possible. In the embodiment of FIG. 6 the fitting sleeve 4 that is moved by the lever 7 is, furthermore, surrounded by an outer housing part 34 that is tightly secured to the remainder of the tubular housing 5, which means it is not displaceable axially when actuation lever 7 is operated. This is how the housing part 34 pushes the catch balls 33 radially inward into the catch groove when the actuation lever 7 is pulled.

A comparison of the embodiments of the fuel hose nozzle 1 of FIGS. 1 (or 2), 4, 5 and 6 shows that the valve 3, in particular the tubular housing 5, the valve housing 8 [9] and the actuation lever 7 are configured identically. The fuel hose nozzles 1 according to these embodiments only differ with respect to their sleeves 4, which are in each case adjusted to fit a certain tank fitting. The subject of the invention also includes a modular system that will optionally allow for the installation of different end fittings or fitting sleeves 4 onto identically configured valves 3. The considerable advantages described above will thereby be achieved

We claim:

1. In combination with a tank having a filler neck, a fuel hose nozzle for filling the tank with liquefied petroleum gas, the nozzle comprising:

a tubular valve housing extending along an axis and having an outer end;

a tubular valve guide axially shiftable in the valve housing between a front position and a rear position and forming an outlet port adjacent the outer end;

a valve in the housing movable between an open position permitting fluid flow into the valve guide toward the outlet end and a closed position preventing such flow, the valve guide forming a chamber axially rearward of the port and axially forward of the valve;

a seal engaged between the valve housing and the valve guide and positioned such that the seal blocks flow from the valve housing into the chamber only in the front position of the valve guide;

a valve piston in the valve guide, axially fixed in the valve housing, and engaged in the front position of the valve guide with the port to block flow through same;

a fitting sleeve surrounding and axially shiftable on the valve housing and having at the outer end an end fitting complementary to the tank filler neck, the valve guide and fitting sleeve being relatively so oriented that, in the front position of the valve guide and when the fitting sleeve is fitted with the tank filler neck, the tank filler neck axially touches or is axially closely juxtaposed with the valve guide;

an actuating lever coupled to the fitting sleeve and to the valve and operable to pull the fitting sleeve rearward on the valve housing out of the front position and open the valve, whereby, when the fitting sleeve is fitted with the tank filler neck, rearward movement of the fitting sleeve on the valve housing pushes the valve guide rearward out of sealing engagement with the piston head; and a spring biasing the valve guide into the front position with the seal blocking flow from the valve housing into the chamber, whereby if the piston breaks while the lever is actuated and the fitting is not engaged with a filler neck, the seal blocks gas from entering the chamber from the valve.

2. The combination defined in claim 1 wherein the actuating lever is pivotal on the valve housing.

3. The combination defined in claim 2 wherein the housing is provided with a stop limiting pivoting of the lever.

4. The combination defined in claim 1 wherein the piston has a head generally axially forward of the valve guide and fittable rearward into the port.

5. The combination defined in claim 1 wherein the end fitting and filler neck have interfitting screwthread formations.

6. The combination defined in claim 1 wherein the end fitting and filler neck have interfitting bayonet formations.

7. The combination defined in claim 1 wherein the end fitting has radially extendable claws and the filler neck has a collar complementarily engageable with the claws.

8. The combination defined in claim 1 wherein the end fitting has angularly arrayed catch balls and the filler neck has a catch groove in which the balls are engageable.

9. The combination defined in claim 1 wherein the fitting sleeve is rotatable on the tubular valve housing.

10. The combination defined in claim 1, further comprising an intermediate ring axially displaceable in the end fitting and axially engageable between the valve guide and the filler neck when the end fitting is fitted to the filler neck.

* * * * *